United States Patent [19]

Romer et al.

[11] Patent Number: 4,671,181

[45] Date of Patent: Jun. 9, 1987

[54] ANTI-TANK SHELL

[75] Inventors: Rudolf Romer; Jürgen Winkelmann; Winfried Rossmann, all of Kaarst, Fed. Rep. of Germany

[73] Assignee: Rheinmetall GmbH, Dusseldorf, Fed. Rep. of Germany

[21] Appl. No.: 95,921

[22] Filed: Nov. 5, 1979

Related U.S. Application Data

[63] Continuation-in-part of Ser. No. 862,224, Dec. 19, 1977, abandoned, which is a continuation of Ser. No. 609,404, Aug. 27, 1975, abandoned, which is a continuation of Ser. No. 379,421, Jul. 11, 1973, abandoned.

[30] Foreign Application Priority Data

Jul. 12, 1972 [DE] Fed. Rep. of Germany ..... 2234219

[51] Int. Cl.[4] ..... F42B 11/06

[52] U.S. Cl. ..... 102/518; 102/364; 102/521

[58] Field of Search ..... 102/52, 56, 93, 92.1–92.7, 102/DIG. 7, 517–523, 501, 703, 473, 364

[56] References Cited

U.S. PATENT DOCUMENTS

| | | | |
|---|---|---|---|
| 1,278,357 | 9/1918 | Lachman | 102/52 |
| 2,303,449 | 12/1942 | Fleischmann | 102/92.2 |
| 2,663,259 | 12/1953 | Catlin et al. | 102/93 X |
| 2,996,011 | 8/1961 | Dunlap | 102/93 |
| 3,096,715 | 7/1963 | Dufour | 102/52 |
| 3,213,792 | 10/1965 | Grenander et al. | 102/52 |
| 3,620,167 | 11/1971 | Romer et al. | 102/93 |
| 3,750,578 | 8/1973 | Blajda | 102/93 X |
| 3,888,636 | 6/1975 | Sczerzence | 102/52 X |
| 3,935,817 | 2/1976 | Riparbelle | 102/52 |
| 4,075,946 | 2/1978 | Deffayet et al. . | |

FOREIGN PATENT DOCUMENTS

| | | | |
|---|---|---|---|
| 603139 | 6/1948 | United Kingdom | 102/93 |
| 887124 | 1/1962 | United Kingdom | 102/52 |

*Primary Examiner*—Harold J. Tudor

*Attorney, Agent, or Firm*—Karl F. Ross; Herbert Dubno

[57] ABSTRACT

An armor-piercing projectile has a steel jacket threadedly or otherwise positively connected with a core which has a forwardly projecting point and leaves a space to the rear of the jacket receiving an incendiary charge and a winged tail unit mechanically connected with that charge. Upon penetration of an armor plate, the tail unit is torn from the jacket and extracts the incendiary charge which then ignites and destroys the surrounding armor.

9 Claims, 2 Drawing Figures

ANTI-TANK SHELL

CROSS-REFERENCE TO RELATED APPLICATIONS

This is a continuation-in-part of our copending application Ser. No. 862,224 filed Dec. 19, 1977 as a continuation of our prior application Ser. No. 609,404 filed Aug. 27, 1975, which is a continuation of Ser. No. 379,421 filed July 11, 1973, all now abandoned.

FIELD OF THE INVENTION

Our present invention relates to an armor-piercing projectile, more particularly an anti-tank shell, comprising a metallic core disposed in a jacket which may be rotationally and/or aerodynamically stabilized. Such a shell can be of the full-caliber or the subcaliber type.

BACKGROUND OF THE INVENTION

For the attainment of a high starting speed with limited energy consumption, the jackets of such shells are often made of a material of lower specific weight, usually aluminum, while the core consists usually of tungsten.

It has been found that conventional shells of this type are relatively ineffectual against stacked targets, i.e. a plurality of plates disposed one behind the other. In spin-stabilized shells, for example, a forward portion of the shell core is consumed (i.e. smashed) upon the penetration of the first plate. The spin drives the core fragments apart so that they are no longer effective against the following plate.

Fin-stabilized anti-tank impact shells of elongate shape have no spin or only a very slight so-called equalization spin. The latter is so small that it does not cause the above-described disadvantageous effect with stacked-plate targets. These projectiles are therefore fairly effective against such targets, provided that the impact angles are relatively steep.

During the passage of such shell through a stacked-plate target at a flat angle, however, the rod-shaped shell bends in the forward plate. As a result, the shell fragments scatter in the following plates and do not impinge close to one another at a point of the main armor, thus losing some of their power. The destruction of the shell is due to a deflection from its path during penetration of an armor plate at a large angle to the plate normal.

OBJECT OF THE INVENTION

It is the object of our present invention to provide an anti-tank shell of high penetration power effective against single-plate as well as stacked-plate armor even when striking same at a small angle of inclination to the plate surface.

SUMMARY OF THE INVENTION

In accordance with the present invention, the core of our improved projectile is rigidly connected over its entire length with a surrounding jacket which consists of a high-strength metal, preferably a steel with a yield point of more than 100 kg/mm$^2$. For the core we prefer to use a heavy metal of a specific weight greater than about 150 g/cm$^3$.

The rigid connection between the jacket and the core consists advantageously of a thread coupling, though welding may also be used.

We thus achieve a very firm bond between the steel jacket and the core. By this arrangement a bursting of the core during penetration of the forward plate of a stack is limited to a small fraction of the shell head, so that the unspent kinetic energy of the shell is available for the penetration of further plates.

During the passage through an armor plate the front end of the shell upsets itself with formation of a correspondingly large puncture so that the following shell part, which is held together by the jacket, can pass through without hindrance.

In this way the shell, after penetrating several armor plates, still carries an incendiary charge highly effective against the actual target.

Pursuant to a more particular feature of our invention, that charge comprises a pyrotechnical incendiary mass received in a space left by the core in the rear part of the jacket. We further provide retaining means connected with that charge and extending radially beyond the jacket at the rear end thereof for extracting the charge from the jacket upon coming into contact with an armor plate penetrated by the shell body. The retaining means, pursuant to yet another feature of our invention, advantageously comprises a winged tail unit serving to stabilize the projectile in flight.

Thus, contact of the tail unit with the arresting armor plate exposes the pyrotechnical incendiary charge and causes it to ignite while the shell body, i.e. the jacket and the core threadedly connected with each other, moves through the remainder of the armor. Such ignition, therefore, would take place directly within the hole left by the shell so as to destroy the surrounding armor.

According to a further feature of our invention, the projectile may be surrounded during firing by a jettisonable drive cage or sabot with a radial extent exceeding that of the retaining means, i.e. of the tail unit, whereby the latter is protected against premature detachment as the shell leaves the barrel.

SPECIFIC DESCRIPTION

Figure 1:
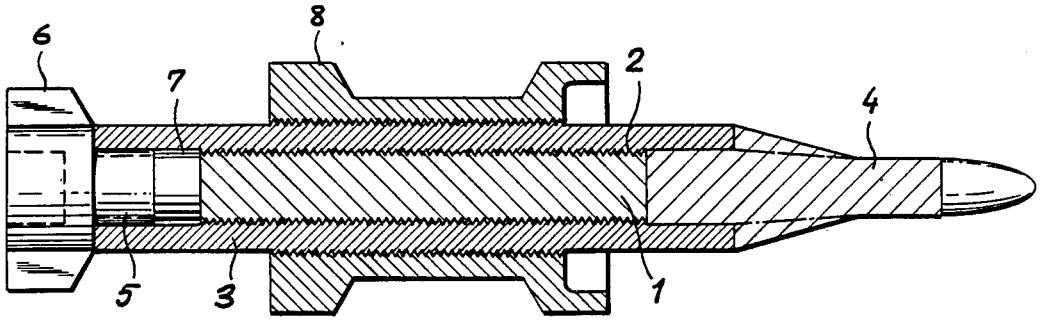
FIG. 1 is an axial sectional view of an anti-tank shell embodying our present invention.

As shown in the drawing, the shell has a core 1 of heavy metal which is held in a throughgoing axial bore of a jacket 3, consisting of a high-strength steel, by means of male threads 2 on its outer surface matingly engaging corresponding female threads of the jacket 3. A member 4 forming the shell head is firmly seated in the forward open end of the jacket and preferably consists of the same working material as the core, i.e. a heavy metal. Also the entire core can be produced integrally. In this case the jacket 3 is faired, as indicated in the drawing in dotted lines, into a taper of the core surface in an intermediate region of head 4.

A core material consisting of about 95% tungsten, 3.4% nickel and 1.6% iron has been found particularly advantageous since it has a greater ductility than the tungsten cores used mostly until now.

The shell has a winged tail unit 6, which has a hub 5 threaded or press-fitted into the trailing end of the jacket rearwardly of the core. A pyrotechnical incendiary charge 7 is connected with the hub 5 which is pulled out from the shell after penetration of a plate causes separation of tail unit 6 from the shell whereupon the incendiary charge is exposed and can be ignited.

Furthermore, the shell has a drive cage or sabot 8 which is thrown off after leaving the barrel, as described in our prior U.S. Pat. No. 3,620,167, cage 8 being threadedly connected with the midsection of the shell jacket 3.

Figure 2:
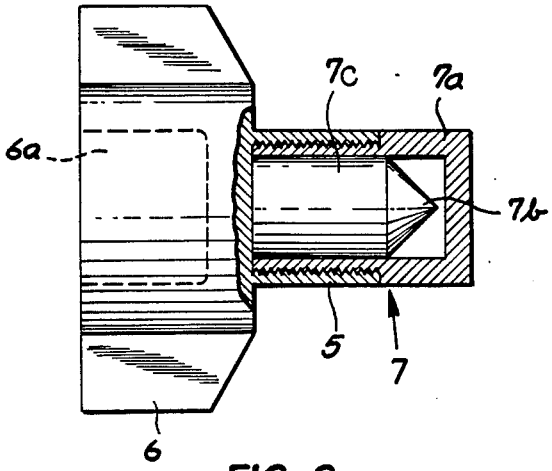
FIG. 2 is an enlarged part-sectional detail view.

As more fully illustrated in FIG. 2, incendiary charge 7 comprises a shaped mass *7c* which is enclosed in a cylindrical housing *7a* threaded into the hub 5 of the tail unit 6 and, advantageously, has a conical tip *7b* adjoining the closed forward end of that housing. Thus, when the projectile penetrates the first armor plate of a target and continues on its way, the tail unit 6 is arrested by that plate and also retains the housing *7a* while the mobile mass *7c* is forced by inertia with its tip *7b* against the housing wall and ignites under the impact. No such impact occurs during firing when the mass 5 rests with its broad end against the tail unit as the projectile is accelerated by the propulsion gases developed within the launcher.

Tail unit 6 has a recess *6a* which may carry a tracer pellet.

We claim:

1. An armor-piercing projectile comprising:

an open-ended metallic jacket having a throughgoing axial bore;

a core of heavy metal in said bore rigidly connected therewith, said core terminating short of a rear end of said jacket and having a pointed head projecting from a front end thereof, thereby leaving a space in said bore rearwardly of said core;

an impact ignitable pyrotechnical incendiary charge in said space; and retaining means at said rear end connected with said charge and extending radially beyond said jacket for extracting said charge from said jacket upon coming into contact with an armor plate penetrated by said jacket.

2. A projectile as defined in claim 1 wherein said retaining means is a winged tail unit.

3. A projectile as defined in claim 2 wherein said tail unit has a hub extending into said space.

4. A projectile as defined in claim 1, 2 or 3 wherein jacket and said core are threadedly interconnected.

5. A projectile as defined in claim 1, 2 or 3 wherein jacket has a front portion faired into a tapered surface zone of said head.

6. A projectile as defined in claim 1, 2 or 3 wherein jacket consists of high-strength steel and said core consists at least in part of a tungsten alloy.

7. A projectile as defined in claim 6 wherein said alloy consists of substantially 95% tungsten, balance nickel and iron.

8. A projectile as defined in claim 7 wherein the proportions of nickel and iron in said alloy are substantially 3.4% and 1.6%, respectively.

9. A projectile as defined in claim 1, 2 or 3 wherein comprising a jettisonable drive cage on said jacket with a radial extent exceeding that of said retaining means.

* * * * *